United States Patent [19]

Lindholm et al.

[11] 3,932,205

[45] Jan. 13, 1976

[54] HEAT TREATING PROCESS FOR ACHIEVING FORCED AGEING

[75] Inventors: Gosta Lindholm; Erling Astrom, both of Vasteras, Sweden

[73] Assignee: Allmanna Svenska Elektriska Aktiebolaget, Vasteras, Sweden

[22] Filed: Mar. 31, 1975

[21] Appl. No.: 563,503

[30] Foreign Application Priority Data

Apr. 11, 1974 Sweden ..... 74049776

[52] U.S. Cl. ..... 148/108; 29/597; 310/179; 148/142; 148/154

[51] Int. Cl.[2].. C21D 1/04; C21D 1/10; H01R 43/00

[58] Field of Search ..... 148/108, 103, 142, 150, 148/154; 29/596, 597; 310/173, 174, 177, 179, DIG. 2, DIG. 4, DIG. 5

[56] References Cited

UNITED STATES PATENTS

| | | | |
|---|---|---|---|
| 2,181,921 | 12/1939 | Schlup | 148/154 |
| 2,782,330 | 2/1957 | Baclawski | 29/597 |
| 3,894,892 | 7/1975 | Conta | 148/108 |

*Primary Examiner*—Walter R. Satterfield

[57] ABSTRACT

For forced ageing of a commutator intended for a rotary electrical machine while the commutator is being rotated, heat is being supplied to it by a coil for generating a high frequency magnetic field arranged outside the commutator in such a way that the field is directed substantially perpendicular to the commutator surface, the coil being supplied with a current of a frequency of at least 1,000 Hz.

1 Claim, 2 Drawing Figures

HEAT TREATING PROCESS FOR ACHIEVING FORCED AGEING

BACKGROUND OF THE INVENTION

1. Field of the Invention

The present invention relates to a heat treating process for achieving a forced ageing of a commutator for a rotary electrical machine, by supplying heat during rotation.

2. The Prior Art

The commutator in question consists of a plurality of segments arranged tangentially one after the other and with intermediate insulating plates. These segments are clamped in the axial direction so that together they form a rigid body. During operation of the electric motor, the commutator is heated and its segments tend to expand, which, because of the clamping, results in the segments being bent to a great or a small extent radially outwards, radially inwards or in a tangential direction. Since some of the deformations connected herewith, for example deformations in the insulating material, are of a permanent nature, the different segments of a newly-made machine will at first change their shape and/or positions at each new heating. Consequently it is no use finish-turning the commutator as long as the stabilization of the hot commutator conditions has still not taken place.

The expression "forced ageing" refers to a heat treatment of the commutator which is carried out for the purpose of stabilization before the machine is delivered, and before the final turning of the commutator has taken place.

Attempts to achieve the above-mentioned stabilization by repeatedly heating the commutator to maximum temperature by blowing in hot air or heating in a furnace will seldom result in acceptable results, since the temperature distribution in copper, the relation between the iron and the copper temperatures and certain other circumstances prevailing during such heating differ very much from heating under normal operating conditions. The commutator looses at full load, that is the effect which to a great extent is transferred to heat in the commutator, consist of the effect caused by the voltage drop of the brushes together with the effect which is developed by the friction of the brushes against the commutator surface.

Nowadays it is commonly recognized that, in the case of forced ageing of a commutator, the heat should be supplied in a manner that corresponds as much as possible to heating in normal operation. During normal operation the commutator losses are constituted to a great extent (20 – 60%) by the friction losses and for the rest by the heat developed in connection with the current transfer between the brushes and the commutator surface. The resistance losses in the interior of the segments are insignificant. According to the ageing method which is nowadays considered to provide the best result — the socalled block treatment — the commutator is heated by friction heat only. Even if this simulation of the actual conditions is not quite perfect, it is all the same the question of heat which is only supplied to the radially outer surface of the segments and also over the same axial distance as in normal operation.

In the block treatment method there are arranged, for example, wooden blocks which exert a pressure on the commutator surface whereas the rotor is brought into rotation by means of an auxiliary motor. A disadvantage of the block treatment is that the heating must be allowed to take place very slowly in order that the method can be performed without the risk of a radial deformation of the segments. If one of the segments protrudes to a relatively great extent already at the start of the block treatment, this will involve a risk that a relatively great part of the released braking effect will be concentrated in the protruding segment, thus causing a further deflection.

SUMMARY OF THE INVENTION

In a method according to the invention, the imitation of the normal operating condition by using friction heat during forced ageing is renounced. Thus, the advantage is obtained that the time of treatment required for the ageing process can normally be reduced to a fraction, normally less than one fourth of the hitherto usual treatment time. In addition, the risk of individual segments being too strongly heated and in consequence deformed, as described above, is eliminated.

According to the invention, this is achieved by rotating the commutator in the magnetic field of a coil which generates a high frequency magnetic field and which is arranged radially outside the commutator in such a way that the field is directed substantially perpendicular to the commutator surface. The coil is supplied with current having frequency of at least 1,000 Hz, preferably from 1,600 to 15,000.

BRIEF DESCRIPTION OF THE DRAWINGS

The invention is characterised by what is stated in the claim and will be described in the following with reference to the accompanying drawing, in which.

DESCRIPTION OF THE PREFERRED EMBODIMENTS

Figure 1:
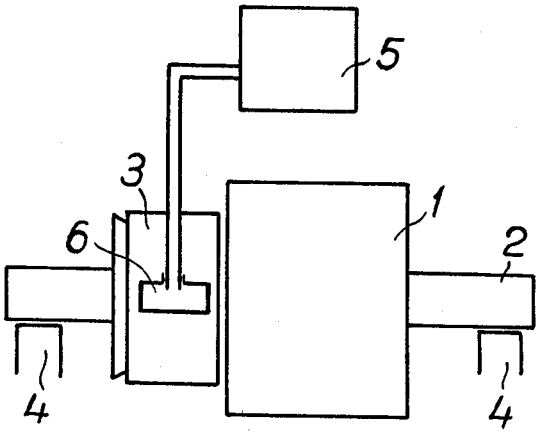
FIG. 1 shows a rotor in a commutator machine in a side view and FIG. 2 in an end view.
Figure 2:
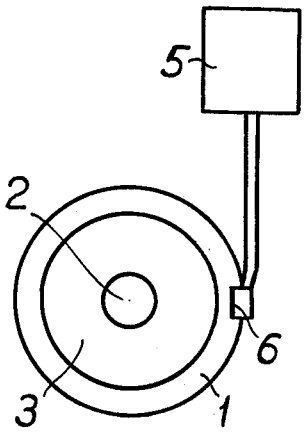

In the drawing, 1 designates the rotor core, 2 the rotor shaft and 3 the commutator of the machine. The rotor is journalled in bearings 4, which may belong to a permanent equipment for forced ageing according to the invention but which may also be the ordinary bearings of the machine. This equipment also includes a high-frequency generator 5 for frequencies of at least 1,000 Hz, suitably from 1,600 to 15,000 Hz, and a coil 6 connected to the generator 5, and an auxiliary motor (not shown in the drawing) by means of which the rotor is maintained in rotation at a speed which may suitably be about 20% of the maximum speed of the machine, but also higher. The coil 6 is arranged at a short distance from the commutator surface in such a way that the lines of force are directed substantially perpendicular to the commutator surface. Eddy currents will then be induced in the segments in the vicinity of the commutator surface. Because of the high frequency, the penetration depth of the flux will be small, so that the corresponding power development is confined to a thin layer in the radial outer part of the segments, in the same way as in normal operation. As far as the amount is concerned, however, the power can differ considerably from the commutator losses in normal operation. By choosing it to be considerably higher than the normal commutator losses, for example at least four times as great as these losses, a completely stabilizing forced ageing can be achieved in a considerably shorter time than is common when using known methods.

The method may comprise several, but generally not more than about ten heating/cooling procedures, and at each heating the temperature of the segments is measured and the supply of power is controlled so that the desired temperature with a tolerance of about ± 10°C is obtained.

I claim:

1. Heat treating process for forced ageing of a commutator intended for a rotary electrical machine by supplying heat during rotation, which comprises rotating the commutator in the field of a coil intended for generating a high-frequency magnetic field arranged radially outside the commutator in such a way that said field is directed substantially perpendicular to the commutator surface, and supplying to said coil a current, the frequency of which exceeds 1,000 Hz.

* * * * *